US005648631A

United States Patent [19]

Kirschner et al.

[11] Patent Number: 5,648,631

[45] Date of Patent: Jul. 15, 1997

[54] SPOOLED TAPE SEAL FOR UNDERWATER GUN OPERATION

[75] Inventors: Ivan N. Kirschner, Portsmouth; Laurence M. Dean, Newport; Richard B. Philips, Barrington, all of R.I.

[73] Assignee: The United States of America as represented by the Secretary of the Navy, Washington, D.C.

[21] Appl. No.: 540,419

[22] Filed: Oct. 3, 1995

[51] Int. Cl.[6] ..... F41C 9/06

[52] U.S. Cl. ..... 89/1.14

[58] Field of Search ..... 42/1.14; 89/1.809, 89/1.81, 1.817, 5, 31; 102/399

[56] References Cited

U.S. PATENT DOCUMENTS

| | | | |
|---|---|---|---|
| 45,020 | 11/1864 | Cleu | 89/31 |
| 3,077,143 | 2/1963 | Draim et al. | 89/1.809 |
| 3,323,457 | 6/1967 | Biehl et al. | 42/1.14 |
| 4,671,163 | 6/1987 | Erikson | 89/1.81 |
| 4,848,209 | 7/1989 | Almeras | 89/1.14 |

FOREIGN PATENT DOCUMENTS

| | | | |
|---|---|---|---|
| 387199 | 7/1908 | France | 89/5 |
| 2424480 | 12/1974 | Germany | 89/1.817 |
| 94041 | 3/1852 | United Kingdom | 89/5 |
| 2074296 | 10/1981 | United Kingdom | 89/1.817 |

*Primary Examiner*—Stephen M. Johnson

*Attorney, Agent, or Firm*—Michael J. McGowan; James M. Kasischke; Prithvi C. Lall

[57] ABSTRACT

The present invention relates to an underwater weapon having a system for sealing the opening of a gun barrel to prevent the ingress of water. The sealing system includes a non-metallic or metallic tape for covering and sealing the opening and a mating surface on the gun barrel against which the tape is seated to prevent the ingress of water. The sealing system further includes sprockets for advancing the tape across the opening of the gun barrel and for maintaining the tape in a taut position during operation.

17 Claims, 3 Drawing Sheets

SPOOLED TAPE SEAL FOR UNDERWATER GUN OPERATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an apparatus for preventing the ingress of water into an underwater gun before, during and after the firing of a projectile and a method for sealing an underwater gun barrel opening.

(2) Description of the Prior Art

Little work has been done on apparatus for keeping water out of a gun barrel because until recently it has not been practical to shoot bullets underwater. Newly proven, supercavitation drag reduction techniques now allow bullets to be fired underwater at high enough speeds to cause damage. Accordingly, there is a need for simple and effective means for sealing underwater gun barrels to preclude the entry of water.

Excluding water from a gun barrel is important to underwater gun operation. If water is allowed to enter the gun barrel before or after firing the gun, the gun will not operate effectively.

The prior art includes various devices relating to underwater guns such as disclosed in U.S. Pat. Nos. 44,631; 367,153; 1,270,988; 3,300,888; 3,616,561; 3,729,853; and 4,821,441. For example, U.S. Pat. No. 44,631 discloses a submarine shot conductor having an India-rubber valve mounted on the open end of the shot barrel. Similarly, U.S. Pat. No. 1,270,988 discloses an underwater gun whereby the gun muzzle is sealed by a pivotally mounted cap portion. U.S. Pat. No. 367,153 discloses a submarine gun and port whereby the port which receives the gun barrel is exposed by means of a sliding gate. Multishot guns for underwater use are disclosed in U.S. Pat. Nos. 4,821,441 and 3,729,853 and 3,616,561. These prior art devices do not provide adequate sealing of the gun barrel to preclude the entry of water and/or are overly complex and not practical underwater guns.

U.S. Pat. No. 3,323,457 to Biehl et al., U.S. Pat. No. 3,453,763 to Barr et al. and U.S. Pat. No. 3,580,172 to Hendricks illustrate some other underwater weapons. Keeping the barrel of the weapon clear of water is important to underwater gun operation because it reduces the energy required to eject the bullet, it increases the muzzle velocities that can be achieved, and it reduces the strength requirements and thus the weight of the barrel.

In the Biehl et al. patent, the underwater weapon comprises a device for launching a projectile. One end of the projectile is covered by a frangible diaphragm. The diaphragm is used to maintain the watertightness of the launcher. In operation, the projectile within the launcher is ejected through the frangible diaphragm. The Barr et al. patent relates to an underwater pistol having a rotatable cylindrical magazine. During operation of this pistol, a projectile is driven through a frangible, and fully removable, sealed front barrel cover. The Hendricks patent also illustrates an underwater weapon in which a projectile resides within a launch tube or barrel having a removable plug affixed at one end to prevent the ingress of water.

Other devices are known in the art to render firearms waterproof. U.S. Pat. No. 3,677,132 to Plenge illustrates a muzzle attachment for the barrel of a firearm. The muzzle attachment includes a device for sealing the muzzle behind a bullet passing therethrough to prevent the escape of expanding gases. This device takes the form of a plurality of polyurethane discs sandwiched between flat metallic washers and spaced apart by ring members. The plugs are x-slotted on both faces thereof for permitting a bullet to pass therethrough without fragmenting or rupturing the element. The disc or plug automatically closes and reseals itself after a bullet has been fired. When the muzzle attachment is threadably engaged with the gun barrel, the weapon is waterproof from the barrel end thereof. U.S. Pat. No. 5,105,571 to Kinchin et al. also relates to a method and apparatus for preventing moisture from entering a firearm. In this patent, lightweight plastic covers are disclosed for use as seals for the openings of a firearm such as the muzzle opening or the magazine well opening. The plastic covers are removable through manual operation. It is also possible to remove the covers by actually firing the weapon.

U.S. Pat. No. 4,848,209 to Almeras discloses sealing a driving apparatus for an underwater device. The apparatus includes a barrel holder, a barrel for guiding a fastener intended to be driven by the gases of a propulsive charge and a percussion system for setting of the charge. The barrel of the device is closed by a closure device made by a material which may be perforated by the projectile disposed inside the tubular element or gun barrel.

U.S. Pat. No. 4,742,775 to Harris illustrates still another approach for sealing an end of an underwater device. In the Harris patent, a sealing compound is used to prevent water from penetrating the casing.

Despite the existence of these devices for sealing the end of underwater weapons and the like, there is still a need for a more efficient approach for preventing the ingress of water into a gun barrel and, in particular, to an approach wherein a series of shots can be fired without water entering the weapon.

SUMMARY OF THE INVENTION

Accordingly, it is an object of the present invention to provide an improved apparatus for keeping water out of a gun barrel.

It is a further object of the present invention to provide an apparatus as described above which allows a bullet or projectile within a gun barrel to be enveloped in gas until it leaves the barrel.

Still further, it is an object of the present invention to provide an improved method for sealing a gun barrel.

The foregoing objects are attained by the apparatus and method of the present invention.

In accordance with the present invention, an underwater weapon has a tube, such as a gun barrel, having an opening, such as a muzzle, through which a projectile, such as a bullet, is to be discharged. The underwater weapon is also provided with means for sealing the opening to prevent the ingress of water. In a preferred embodiment of the present invention, the sealing means comprises a tape which covers and seals the opening in the tube. The tube is preferably provided with a surface against which the tape is seated by hydrostatic pressure to prevent the ingress of water. In a preferred embodiment, the tape is a non-metallic or metallic tape. In a preferred embodiment, sprockets are provided to advance the tape and to maintain the tape taut when sealing the opening of the tube or gun barrel.

The method of the present invention broadly comprises providing a replaceable tape across the opening of a gun barrel; perforating a section of the tape with a bullet or projectile discharged from the gun barrel opening; and advancing the tape so that a perforated section is replaced by a non-perforated section.

Other details, objects and advantages of the present invention are set forth in the following detailed description and the accompanying drawings wherein like reference numerals depict like elements.

DETAILED DESCRIPTION OF THE PREFERRED EMBODIMENT(S)

Figure 1:
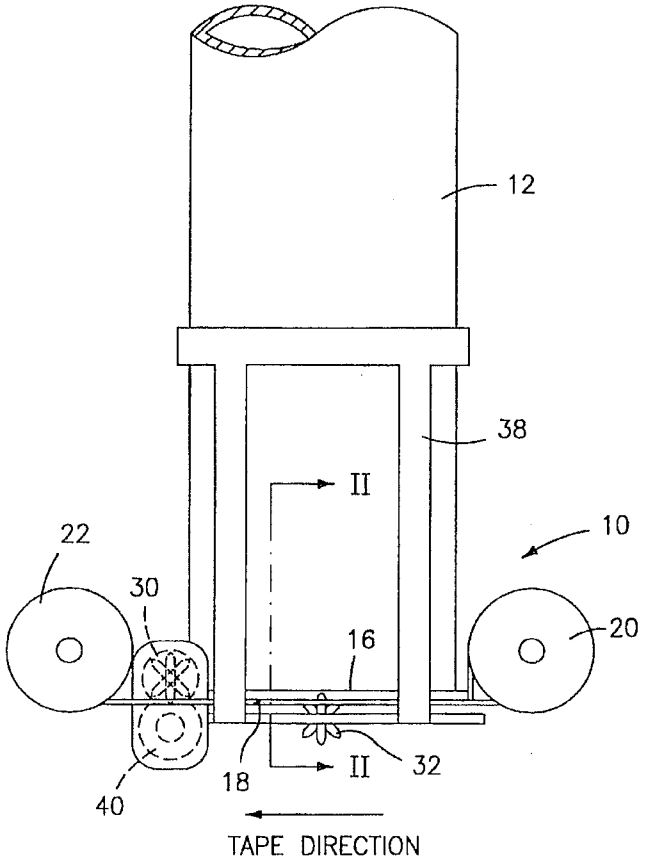
FIG. 1 is a view of the sealing system of the present invention mounted to a gun barrel.

Referring now to the drawings, FIG. 1 illustrates the gun sealing system 10 of the present invention as it is mounted to a gun barrel 12. As shown best in FIG. 2, the gun barrel has an opening 14 through which a projectile (not shown) within the gun barrel 12 is discharged. The gun barrel 12 preferably has attached to one end a piece of thermoplastic such as LEXAN or other deformable material 16 which acts as a mating surface for a sealing means 18 which extends across the opening 14.

The sealing means of the present invention comprises a sealing tape 18 which extends across the opening 14 of the gun barrel. A supply of the sealing tape 18 is maintained on a feeding spool 20 mounted to the gun barrel 12. The manner in which the feeding spool 20 is mounted to the gun barrel 12 does not form part of the present invention and is therefore not described in detail. Any suitable means known in the art may be used to mount the spool 20 to the gun barrel 12.

A take-up spool 22 may be provided to gather up perforated portions of the tape 18. The take-up spool 22 is preferably replaceable, as is the feeding spool 20. The manner in which the take-up spool 22 is mounted to the gun barrel 12 does not form part of the present invention and therefore is not described in detail. Any suitable means known in the art may be used to mount the take-up spool 22 to the gun barrel 12.

Sealing tape 18 can be made from a variety of metallic and non-metallic materials which can be bent around spool 20. The tape 18 used to seal the gun barrel opening or muzzle is preferably formed from an aromatic polyamide fiber material such as KEVLAR, a polyester film material such as MYLAR, or other, non-metallic or metallic material suitable for sealing against salt water. The tape 18 is preferably reinforced along its edges in order to provide it with strength even though it has been perforated by a discharged projectile. Any suitable means known in the art may be used to reinforce the tape. For example, a sandwich construction using the same or different flexible materials may be used to provide a reinforced tape.

Figure 3:
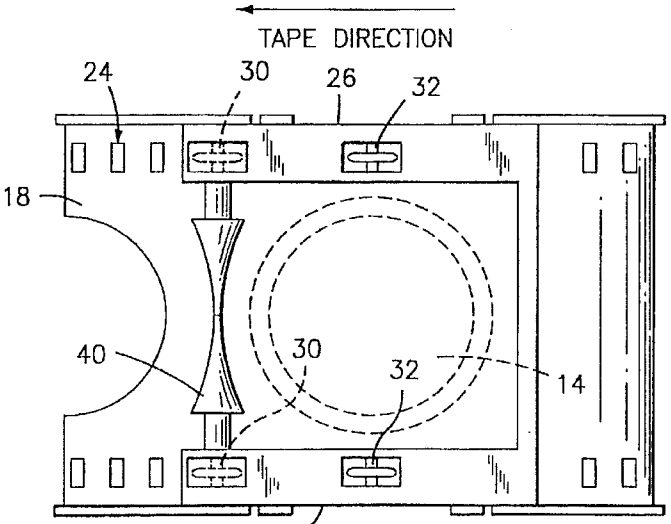
FIG. 3 is a front view of the tape sealing system of the present invention.

As shown in FIG. 3, the tape 18 is provided with a series of slots 24 along its lateral edges 26 and 28. The slots 24 extend along the edges of the tape 18 in the manner of a film strip. As shown in FIGS. 1 and 3, drive sprockets 30 are provided to advance the tape 18 from the feeding spool 20 to the take-up spool 22. Additionally, free wheeling guide sprockets 32 are provided to maintain the tape 18 in a proper position. The guide sprockets 32 and the drive sprockets 30 are also used to maintain the tape 18 taut across the opening 14 of the gun barrel 12.

The manners in which the drive sprockets 30 and the take-up spool 22 are driven do not form part of the present invention and therefore are not described in detail. Any suitable means known in the art may be used to drive the drive sprockets 30 and the take-up spool 22, including electric motors, gas actuation, or actuation taking power from any ammunition feed system employed by the operation of the gun.

Figure 2:
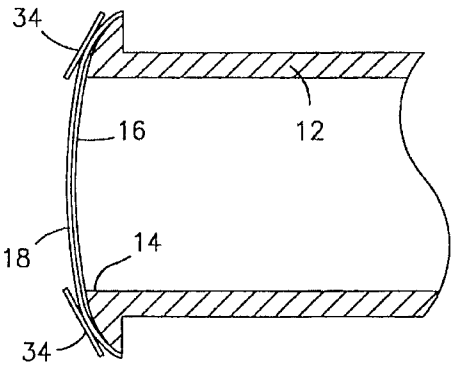
FIG. 2 is a sectional view taken along lines II—II illustrating the sealing tape as it covers the gun barrel opening.

As shown in FIG. 2, guides 34 may be provided to ensure that the tape 18 advances in a manner which aligns it with the opening 14 so as to effectively seal the opening 14. The guides 34, may be mounted to the gun barrel 12 by a bracket arrangement 38 such as that shown in FIG. 1. A practical bracket arrangement might require incorporation of a spring means (not shown) to allow the seal to lift from the muzzle as the gas ahead of the projectile is compressed during launch. Any suitable bracket arrangement 38 and spring means known in the art may be used.

The gun barrel 12 may have either a flat end in which the opening 14 is provided or a curved configuration in which the gun opening 14 and the mating surface 16 are provided as shown in FIG. 2. By properly arranging the guides 34, the tape 18 conforms to the shape of the gun barrel 12.

In operation, a non-perforated portion of the tape 18 is moved in front of the gun barrel opening 14. Hydrostatic pressure causes the tape 18 to seal against the mating surface 16. In this way, water is kept out of the gun barrel 12 so that a projectile or bullet (not shown) within the gun barrel 12 is enveloped in gas until it leaves the barrel. Once the projectile or bullet is discharged from the gun barrel, it will perforate that portion of the tape 18 in front of the opening 14. At this time, the gun barrel 12 is kept clear of water by the exhaust gases of combustion. During this period, the tape 18 is advanced to a new position by sprockets 30 so that a non-perforated portion of the tape 18 is positioned in front of the opening 14 and the perforated portion of the tape is moved away from the opening 14. The external hydrostatic pressure re-seats the tape 18 against the mating surface 16, thereby resealing the gun barrel 12.

The technique of the present invention requires that the material used to seal the gun barrel 12 be strong enough that it can be advanced without tearing, yet weak enough that a bullet or other projectile can perforate it without being thrown off course or losing excessive kinetic energy. For use in marine applications, the tape material must be capable of withstanding a salt water environment.

Referring now to FIG. 3, if desired, the sealing system of the present invention can be provided with an optional roller 40 for smoothing or flattening any burr which occurs when the tape is perforated by the bullet. When the tape 18 and the mating surface 16 are flat, a cylindrical roller may be used to flatten any burr and the tape 18 so that it can be collected on the take-up spool 22. When the tape 18 and the mating surface 16 are curved, as shown in FIG. 2, a curved roller may be used to flatten any burr and the tape 18 so that it can be collected on the take-up spool 22.

Figure 4:
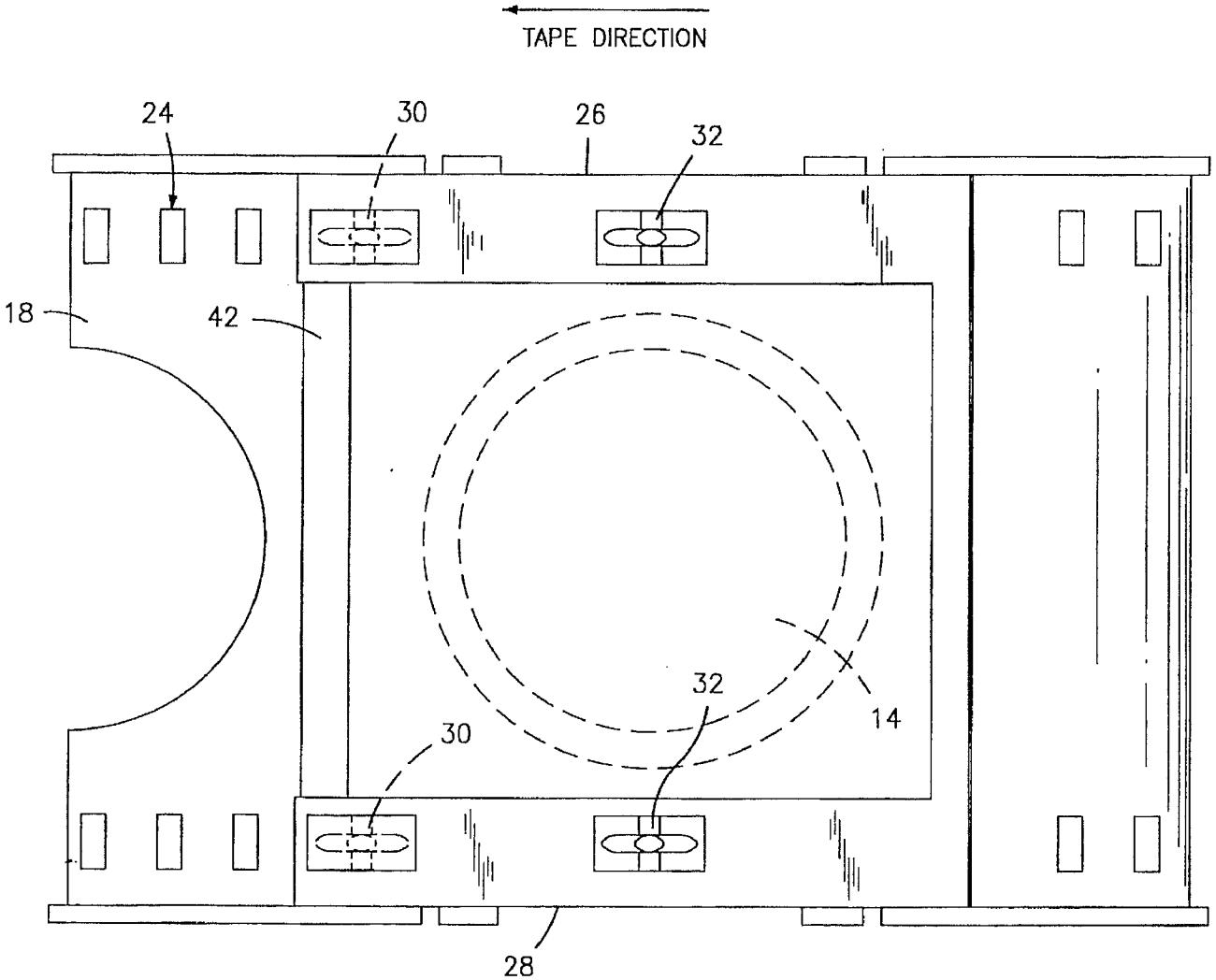
FIG. 4 is a schematic representation of a first alternative embodiment of the gun sealing system of the present invention.

Alternatively, the optional roller 40 can be replaced by a cutting device 42 (see FIG. 4) such as a knife. The knife can be used to remove any burr in the tape 18 before winding the tape 18 on the take-up spool 22. The knife can be used with the tape and the mating surface being either curved or flat.

Figure 5:
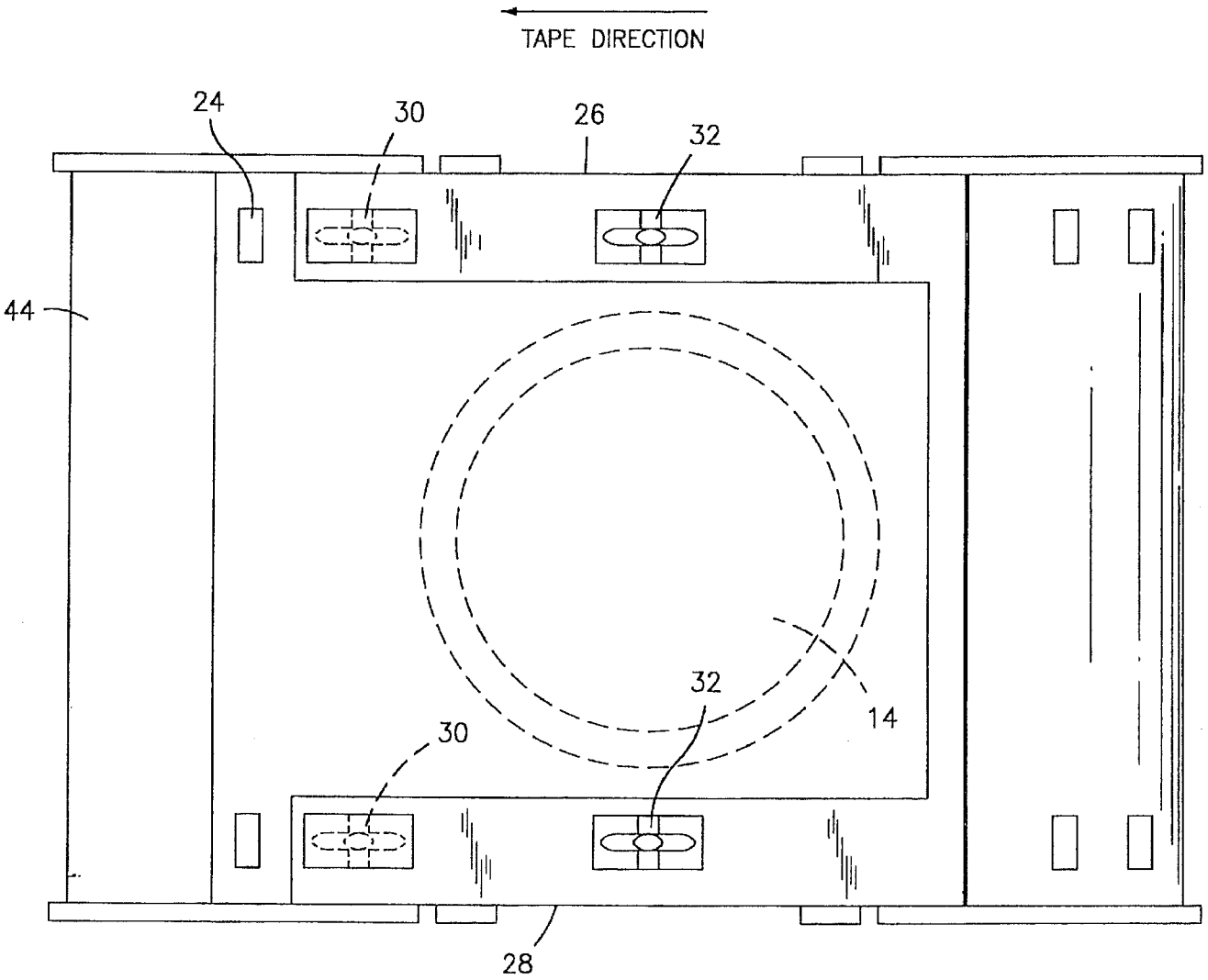
FIG. 5 is a schematic representation of a second alternative embodiment of the gun sealing system of the present invention.

In yet another alternative embodiment (see FIG. 5), the take up spool 22 and the roller 40 are eliminated. Instead, a tape cutting device 44 is mounted to the gun barrel 12 in a position immediately downstream of the drive sprockets 30. The tape cutting device 44 is used to cut off sections of the tape 18. Tape cutting device 44 can be an electrically actuated shearing device for use with metallic tape, a hot wire cutting device for use with non-metallic tape, or any other well known means for cutting tape. This arrangement can also be used when the tape and the mating surface are either curved or flat.

As can be seen from the foregoing description, an effective system for sealing the gun barrel of an underwater weapon has been described. The gun sealing system of the present invention keeps the gun barrel clear of water during operation of the gun. This helps reduce the energy required to eject a projectile or bullet. It also increases the muzzle velocities which can be achieved and reduces the strength requirements and the weight of the gun barrel. The sealing system of the present invention is advantageous in that it may be used in connection with a wide variety of underwater weapons. Additionally, the gun sealing system of the present invention can be automated and thereby eliminates the need to manually replace a device for sealing the gun barrel during operation.

It is apparent that there has been provided in accordance with this invention a spooled tape seal for underwater gun operation which fully satisfies the objects, means, and advantages set forth hereinbefore. While the invention has been described in combination with specific embodiments thereof it is evident that many alternative, modifications, and variations will be apparent to those skilled in the art in light of the foregoing description- Accordingly, it is intended to embrace all such alternatives, modifications, and variations as fall within the spirit and broad scope of the appended claims.

What is claimed is:

1. An underwater weapon comprising:

a tube having an opening therein through which a projectile is discharged;

a tape covering and sealing said opening to prevent the ingress of water, said tape being perforated by discharge of said projectile; and an advancement means joined in fixed relationship to said tube and joined to said tape for allowing intact tape to cover said opening and replace said perforated tape.

2. The underwater weapon of claim 1 wherein:

said tube has a seal mating surface disposed about said opening; and said tape is seated against said mating surface by hydrostatic pressure.

3. The underwater weapon of claim 2 wherein said seal mating surface is formed from a deformable material.

4. The underwater weapon of claim 2 wherein said seal mating surface is curved, and said tape is curved in a complementary manner to seal against said seal mating surface.

5. The underwater weapon of claim 2 wherein said seal mating surface is flat, and said tape is flat to seal against said seal mating surface.

6. The underwater weapon of claim 2 wherein said sealing mating surface is formed from a thermoplastic material.

7. The underwater weapon of claim 2 wherein said advancement means comprises:

a supply spool containing a supply of said tape mounted to said tube to provide said tape seated against said mating surface; and a take-up spool mounted to said tube, said take-up spool receiving tape perforated by said projectile discharged from said tube.

8. The underwater weapon of claim 7 wherein said advancement means further comprises:

sprocket means joined to said tube between said supply spool and said take-up spool, said tape having sprocket holes therein and said sprocket means engaging said tape at said sprocket holes for keeping said tape taut when said tape is sealing said opening and for advancing said tape after said tape has been perforated.

9. The underwater weapon of claim 8 further comprising a roller mounted to said tube between said tube and said take-up spool, said roller smoothing any burrs on said perforated tape.

10. The underwater weapon of claim 8 further comprising a knife for removing any burrs from said perforated tape.

11. The underwater weapon of claim 1 wherein said advancement means comprises:

said tape having sprocket holes therein; and sprocket means joined to said tube for engaging said tape at said sprocket holes and for advancing a non-perforated portion of said tape in front of said opening after said projectile is discharged.

12. The underwater weapon of claim 11 further comprising means for cutting off perforated portions of said tape.

13. An underwater gun for discharging a bullet comprising:

a gun barrel having a muzzle opening through which said bullet can be discharged;

an advancement means joined in fixed relationship to said gun barrel; and tape means joined to said gun barrel to seal said muzzle opening, said tape means being perforated by said bullet as said bullet is discharged from said muzzle opening and said tape means being advanceable by said advancement means so that an intact portion of said tape means reseals said muzzle opening.

14. The underwater gun of claim 13 further comprising:

said gun barrel having a seal mating surface disposed about said muzzle opening; and said advancement means comprising:

a supply spool containing a supply of said tape means mounted to said gun barrel to provide said tape means seated against said mating surface; and a take-up spool mounted to said gun barrel, said take-up spool receiving tape means perforated by said bullet discharged from said gun barrel.

15. The underwater gun of claim 14 further comprising sprocket means joined to said gun barrel between said supply spool and said take-up spool, said tape means having sprocket holes therein and said sprocket means engaging said tape means at said sprocket holes for keeping said tape means taut when said tape means is sealing said opening and for advancing said tape means after said tape means has been perforated.

16. The underwater gun of claim 15 further comprising a roller mounted to said gun barrel between said gun barrel and said take-up spool, said roller smoothing any burrs on said perforated tape means.

17. The underwater gun of claim 15 further comprising a knife mounted to said gun barrel between said gun barrel and said take-up spool, said knife removing any burrs from said perforated tape means.

* * * * *